US007144215B2

(12) United States Patent
Keith et al.

(10) Patent No.: US 7,144,215 B2
(45) Date of Patent: Dec. 5, 2006

(54) METHOD AND APPARATUS FOR COOLING GAS TURBINE ENGINE ROTOR BLADES

(75) Inventors: Sean Robert Keith, Fairfield, OH (US); Michael Joseph Danowski, Cincinnati, OH (US); Leslie Eugene Leeke, Jr., Burlington, KY (US)

(73) Assignee: General Electric Company, Schenectady, NY (US)

( * ) Notice: Subject to any disclaimer, the term of this patent is extended or adjusted under 35 U.S.C. 154(b) by 124 days.

(21) Appl. No.: 10/903,414

(22) Filed: Jul. 30, 2004

(65) Prior Publication Data

US 2006/0024163 A1 Feb. 2, 2006

(51) Int. Cl.
*F01D 5/18* (2006.01)

(52) U.S. Cl. ..... 415/115; 416/97 R; 416/193 A

(58) Field of Classification Search ..... 415/115; 416/97 R, 193 A; 29/889.7, 889.72, 889.721
See application file for complete search history.

(56) References Cited

U.S. PATENT DOCUMENTS

| | | | | |
|---|---|---|---|---|
| 2,972,805 | A * | 2/1961 | Turner et al. | 29/889.721 |
| 3,066,910 | A | 12/1962 | Bluck | |
| 3,989,412 | A * | 11/1976 | Mukherjee | 416/97 R |
| 4,156,582 | A * | 5/1979 | Anderson | 416/96 R |
| 4,183,456 | A * | 1/1980 | Schilling et al. | 29/889.721 |
| 4,244,676 | A * | 1/1981 | Grondahl et al. | 416/96 R |
| 4,312,625 | A | 1/1982 | Pinaire | |
| 4,604,031 | A | 8/1986 | Moss et al. | |
| 4,940,388 | A | 7/1990 | Lilleker et al. | |
| 5,122,033 | A * | 6/1992 | Paul | 416/96 R |
| 5,382,135 | A | 1/1995 | Green | |
| 5,639,216 | A | 6/1997 | McLaurin et al. | |
| 5,813,835 | A | 9/1998 | Corsmeier et al. | |
| 5,848,876 | A | 12/1998 | Tomita | |
| 6,079,946 | A | 6/2000 | Suenaga et al. | |
| 6,092,991 | A | 7/2000 | Tomita et al. | |
| 6,120,249 | A | 9/2000 | Hultgren et al. | |
| 6,132,173 | A | 10/2000 | Tomita et al. | |
| 6,196,799 | B1 | 3/2001 | Fukue et al. | |
| 6,210,111 | B1 | 4/2001 | Liang | |
| 6,227,804 | B1 | 5/2001 | Koga et al. | |
| 6,254,345 | B1 | 7/2001 | Harris et al. | |
| 6,402,471 | B1 | 6/2002 | Demers et al. | |
| 6,416,284 | B1 | 7/2002 | Demers et al. | |
| 6,422,811 | B1 | 7/2002 | Beeck et al. | |
| 6,508,620 | B1 | 1/2003 | Sreekanth et al. | |
| 6,619,912 | B1 | 9/2003 | Tiemann | |
| 6,641,360 | B1 | 11/2003 | Beeck et al. | |

(Continued)

FOREIGN PATENT DOCUMENTS

| | | |
|---|---|---|
| JP | 08-246802 | 9/1996 |

(Continued)

OTHER PUBLICATIONS

European Search Report; Munich; Sep. 1, 2005; Application No. 05254269.3-2315 PCT; 12 pgs.

*Primary Examiner*—Igor Kershteyn
(74) *Attorney, Agent, or Firm*—William Scott Andes; Armstrong Teasdale LLP

(57) ABSTRACT

A method for fabricating a turbine rotor blade includes casting a turbine rotor blade including a dovetail, a platform having an outer surface, an inner surface, and a cast-in plenum defined between the outer surface and the inner surface, and an airfoil, and forming a plurality of openings between the platform inner surface and the platform outer surface to facilitate cooling an exterior surface of the platform.

20 Claims, 8 Drawing Sheets

U.S. PATENT DOCUMENTS

| | | | | |
|---|---|---|---|---|
| 6,644,920 | B1 | 11/2003 | Beeck et al. | |
| 6,719,529 | B1 | 4/2004 | Tiemann | |
| 6,945,749 | B1 * | 9/2005 | De Cardenas | 415/115 |

FOREIGN PATENT DOCUMENTS

| | | |
|---|---|---|
| WO | WO-96/06266 | 2/1996 |

* cited by examiner

METHOD AND APPARATUS FOR COOLING GAS TURBINE ENGINE ROTOR BLADES

BACKGROUND OF THE INVENTION

This application relates generally to gas turbine engines and, more particularly, to methods and apparatus for cooling gas turbine engine rotor blades.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform to a tip, and also includes a dovetail that extends radially inward from a shank extending between the platform and the dovetail. The dovetail is used to couple the rotor blade within the rotor assembly to a rotor disk or spool. At least some known rotor blades are hollow such that an internal cooling cavity is defined at least partially by the airfoil, through the platform, the shank, and the dovetail.

During operation, because the airfoil portion of each blade is exposed to higher temperatures than the dovetail portion, temperature gradients may develop at the interface between the airfoil and the platform, and/or between the shank and the platform. Over time, thermal strain generated by such temperature gradients may induce compressive thermal stresses to the blade platform. Moreover, over time, the increased operating temperature of the platform may cause platform oxidation, platform cracking, and/or platform creep deflection, which may shorten the useful life of the rotor blade.

To facilitate reducing the effects of the high temperatures in the platform region, shank cavity air and/or a mixture of blade cooling air and shank cavity air is introduced into a region below the platform region to facilitate cooling the platform. However, in at least some known turbines, the shank cavity air is significantly warmer than the blade cooling air. Moreover, because the platform cooling holes are not accessible to each region of the platform, the cooling air may not be provided uniformly to all regions of the platform to facilitate reducing an operating temperature of the platform region.

BRIEF SUMMARY OF THE INVENTION

In one aspect, a method for fabricating a turbine rotor blade is provided. The method includes casting a turbine rotor blade including a dovetail, a platform having an outer surface, an inner surface, and a cast-in plenum defined between the outer surface and the inner surface, and an airfoil, and forming a plurality of openings between the platform inner surface and the platform outer surface to facilitate cooling an exterior surface of the platform.

In another aspect, a turbine rotor blade is provided. The turbine rotor blade includes a dovetail, a platform coupled to the dovetail, wherein the platform includes a cast-in plenum formed within the platform, an airfoil coupled to the platform, and a cooling source coupled in flow communication to the cast-in plenum.

In a further aspect, a gas turbine engine is provided. The gas turbine engine includes a turbine rotor, and a plurality of circumferentially-spaced rotor blades coupled to the turbine rotor, wherein each rotor blade includes a dovetail, a platform coupled to the dovetail, wherein the platform includes a cast-in plenum formed within the platform, an airfoil coupled to the platform, and a cooling source coupled in flow communication to the cast-in plenum.

DETAILED DESCRIPTION OF THE INVENTION

Figure 1:
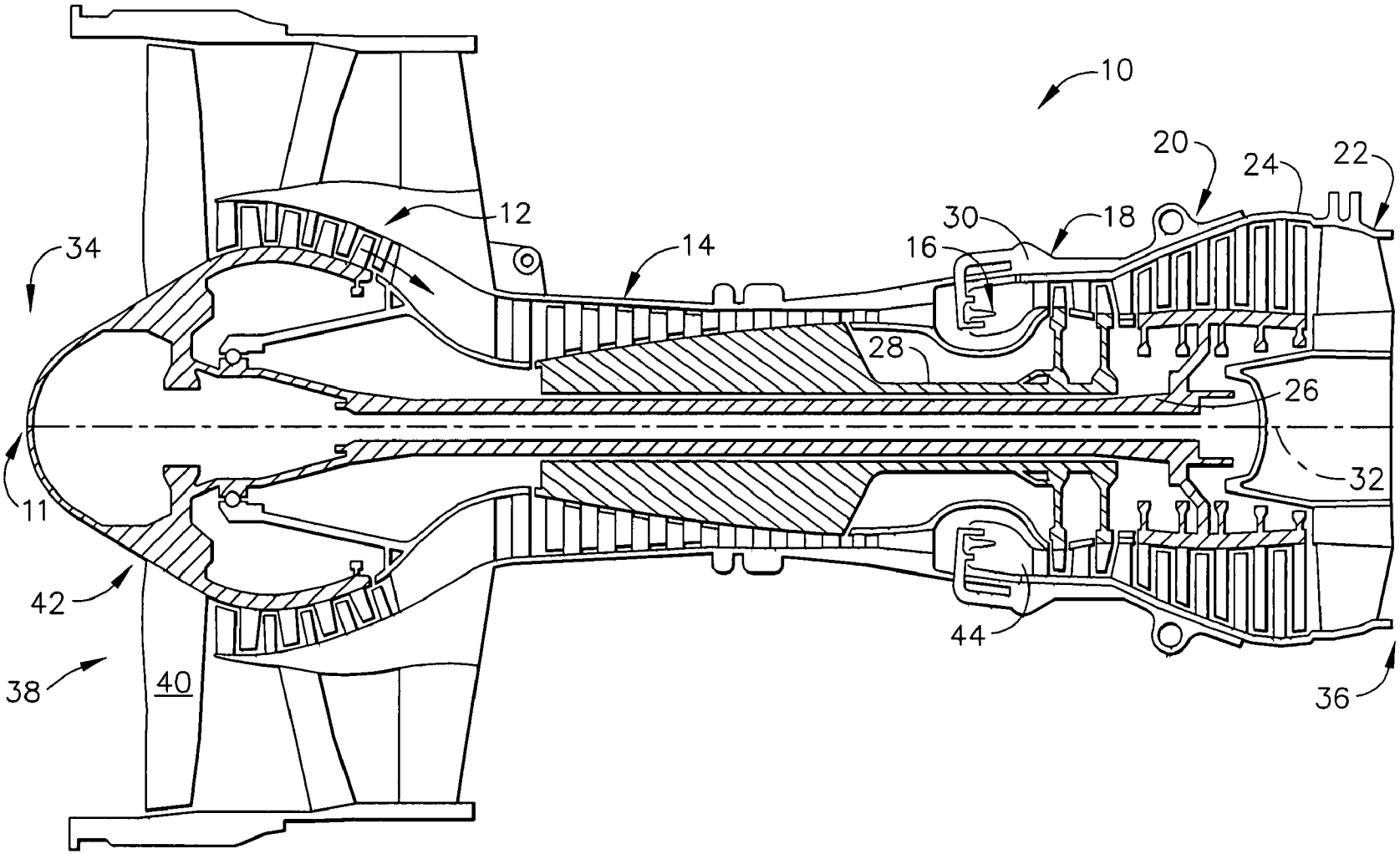
FIG. 1 is a schematic illustration of an exemplary gas turbine engine.

FIG. 1 is a schematic illustration of an exemplary gas turbine engine 10 including a rotor 11 that includes a low-pressure compressor 12, a high-pressure compressor 14, and a combustor 16. Engine 10 also includes a high-pressure turbine (HPT) 18, a low-pressure turbine 20, an exhaust frame 22 and a casing 24. A first shaft 26 couples low-pressure compressor 12 and low-pressure turbine 20, and a second shaft 28 couples high-pressure compressor 14 and high-pressure turbine 18. Engine 10 has an axis of symmetry 32 extending from an upstream side 34 of engine 10 aft to a downstream side 36 of engine 10. Rotor 11 also includes a fan 38, which includes at least one row of airfoil-shaped fan blades 40 attached to a hub member or disk 42. In one embodiment, gas turbine engine 10 is a GE90 engine commercially available from General Electric Company, Cincinnati, Ohio.

In operation, air flows through low-pressure compressor 12 and compressed air is supplied to high-pressure compressor 14. Highly compressed air is delivered to combustor 16. Combustion gases from combustor 16 propel turbines 18 and 20. High pressure turbine 18 rotates second shaft 28 and high pressure compressor 14, while low pressure turbine 20 rotates first shaft 26 and low pressure compressor 12 about axis 32. During some engine operations, a high pressure turbine blade may be subjected to a relatively large thermal gradient through the platform, i.e. (hot on top, cool on the bottom) causing relatively high tensile stresses at a trailing edge root of the airfoil which may result in a mechanical failure of the high pressure turbine blade. Improved platform cooling facilitates reducing the thermal gradient and therefore reduces the trailing edge stresses. Rotor blades may also experience concave platform cracking and bowing from creep deformation due to the high platform temperatures. Improved platform cooling described herein facilitates reducing these distress modes as well.

Figure 2:
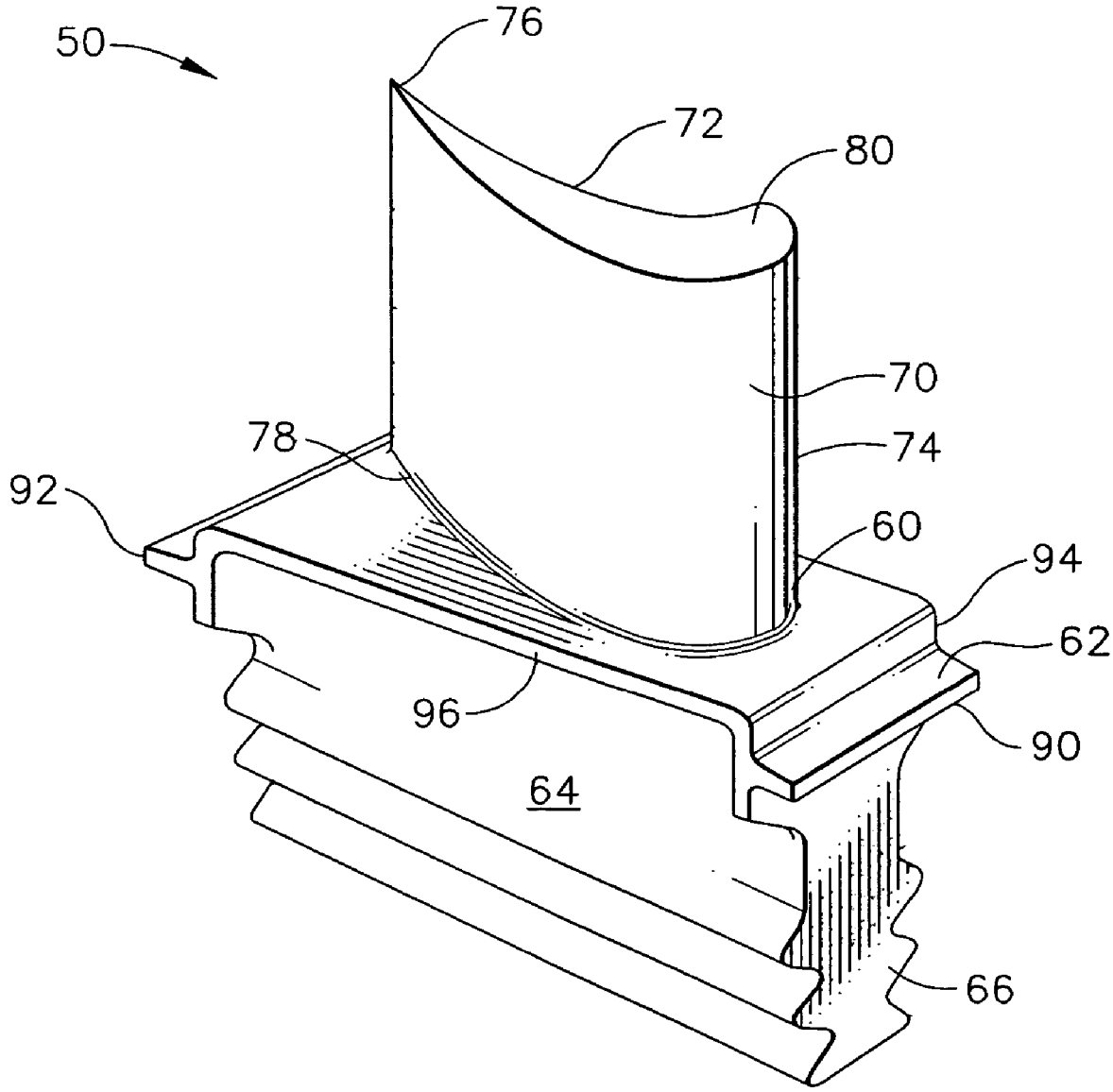
FIG. 2 is an enlarged perspective view of an exemplary rotor blade that may be used with the gas turbine engine shown in FIG. 1.

FIG. 2 is an enlarged perspective view of a turbine rotor blade 50 that may be used with gas turbine engine 10 (shown in FIG. 1). In the exemplary embodiment, blade 50 has been modified to include the features described herein. When coupled within the rotor assembly, each rotor blade 50 is coupled to a rotor disk 30 that is rotatably coupled to a rotor shaft, such as shaft 26 (shown in FIG. 1). In an alternative embodiment, blades 50 are mounted within a rotor spool (not shown). In the exemplary embodiment, circumferentially adjacent rotor blades 50 are identical and each extends radially outward from rotor disk 30 and includes an airfoil 60, a platform 62, a shank 64, and a dovetail 66. In the exemplary embodiment, airfoil 60, platform 62, shank 64, and dovetail 66 are collectively known as a bucket.

Each airfoil 60 includes a first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 62, to an airfoil tip 80. Airfoil tip 80 defines a radially outer boundary of an internal cooling chamber (not shown) that is defined within blades 50. More specifically, the internal cooling chamber is bounded within airfoil 60 between sidewalls 70 and 72, and extends through platform 62 and through shank 64 and into dovetail 66 to facilitate cooling airfoil 60.

Platform 62 extends between airfoil 60 and shank 64 such that each airfoil 60 extends radially outward from each respective platform 62. Shank 64 extends radially inwardly from platform 62 to dovetail 66, and dovetail 66 extends radially inwardly from shank 64 to facilitate securing rotor blades 50 to rotor disk 30. Platform 62 also includes an upstream side or skirt 90 and a downstream side or skirt 92 that are connected together with a pressure-side edge 94 and an opposite suction-side edge 96.

Figure 3:
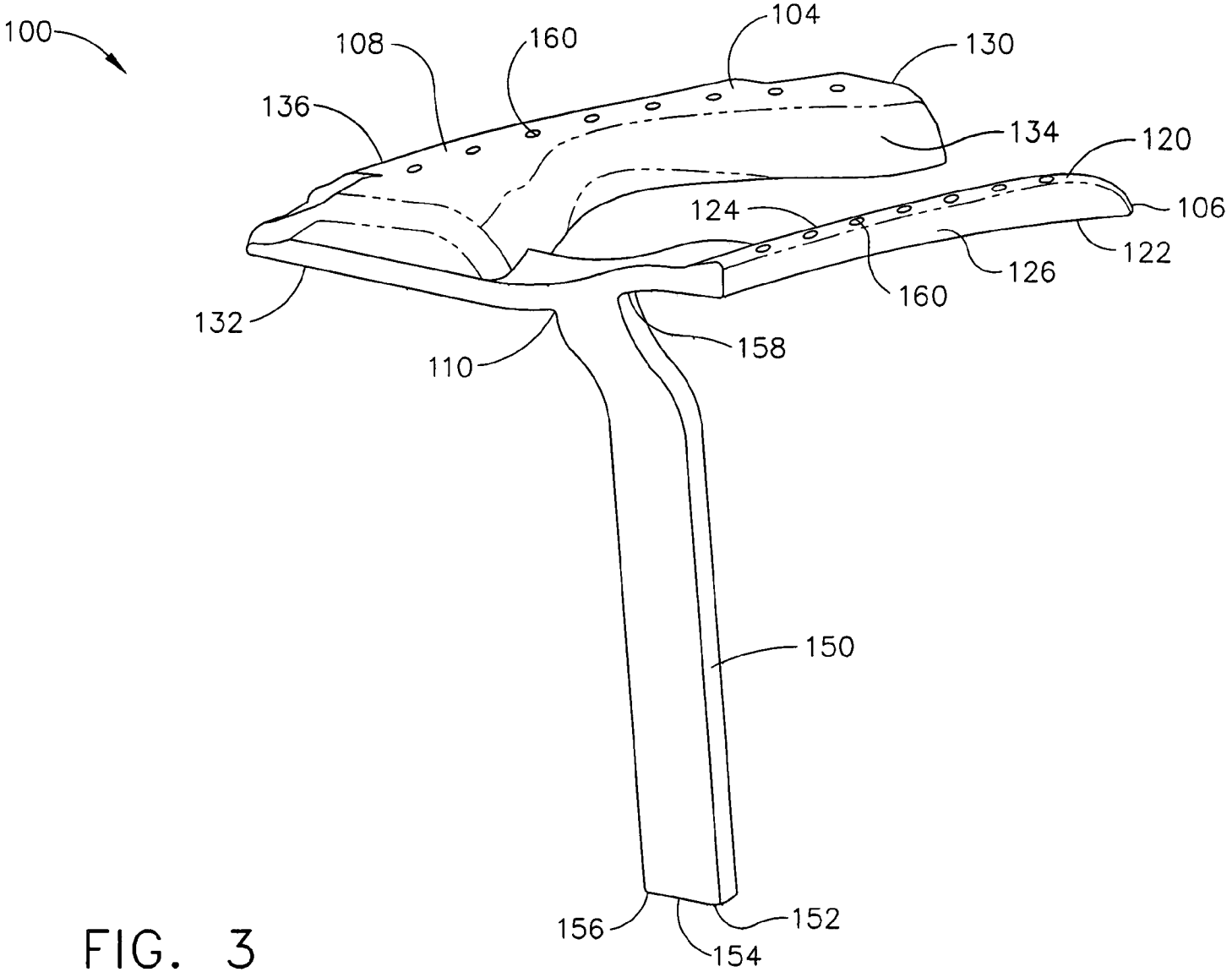
FIG. 3 is a perspective view of an exemplary cast-in plenum.
Figure 4:
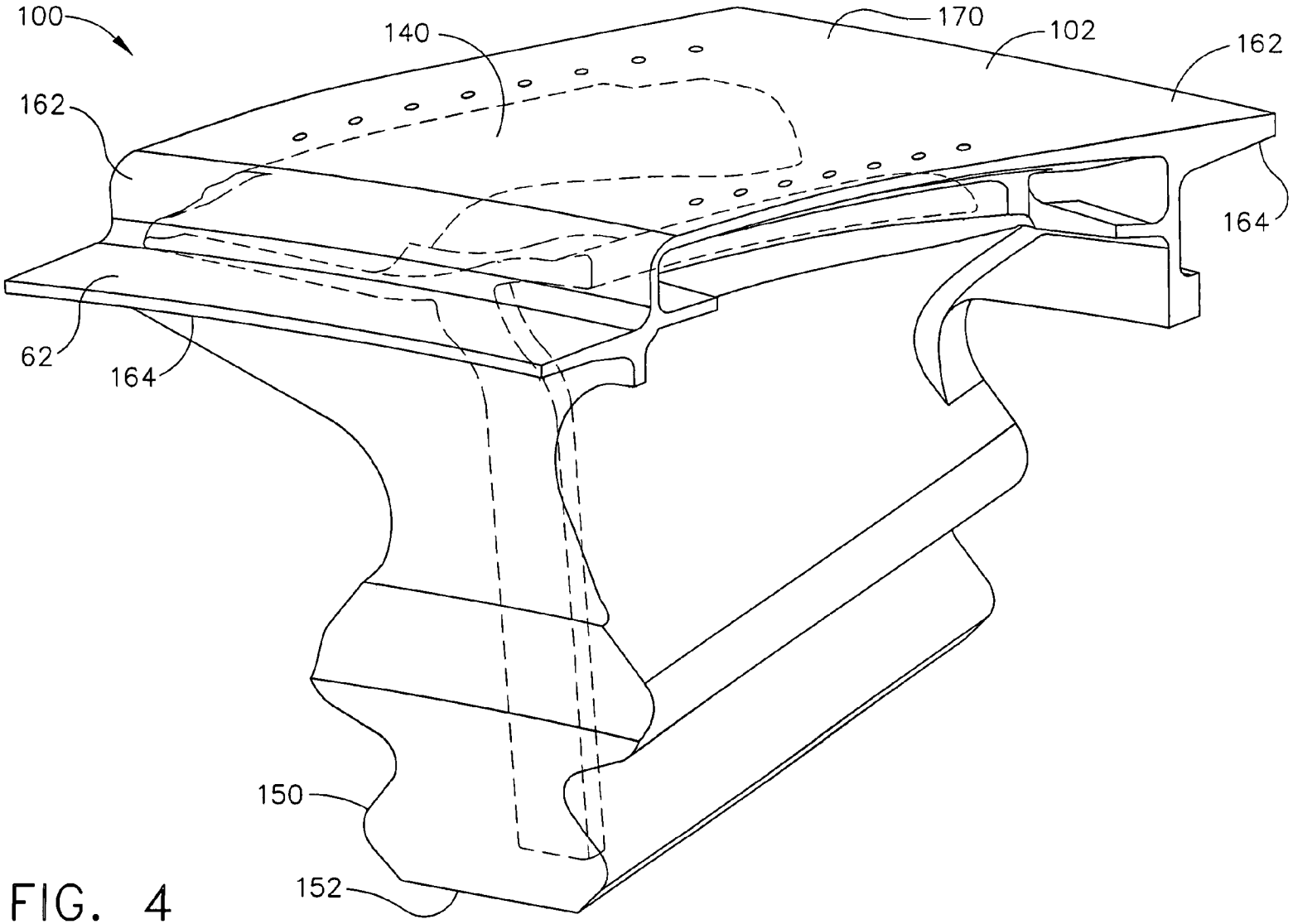
FIG. 4 is a side perspective view of the exemplary gas turbine rotor blade (shown in FIG. 2) that includes the cast-in plenum (shown in FIG. 3)
Figure 5:
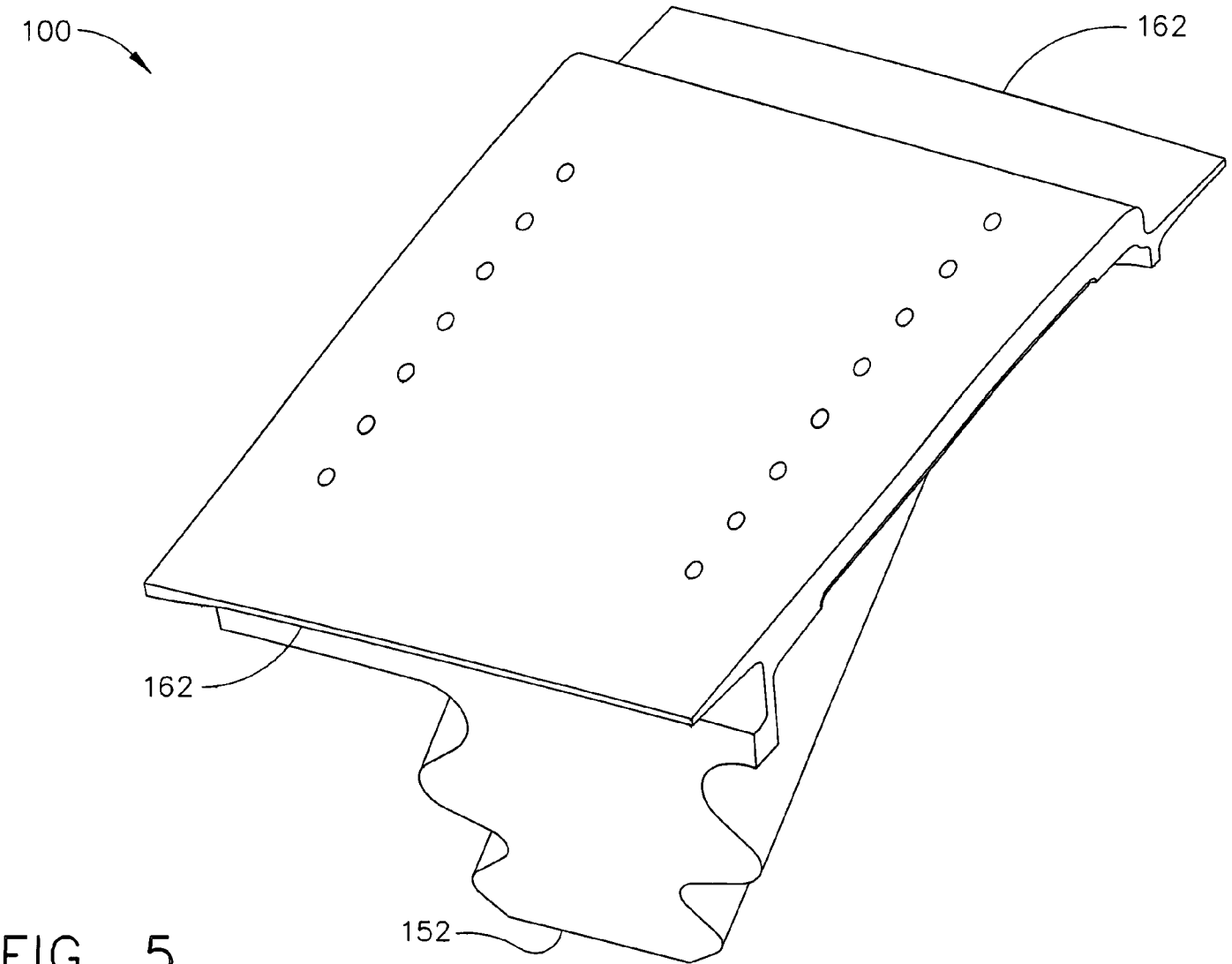
FIG. 5 is a top perspective view of the exemplary gas turbine rotor blade (shown in FIG. 2) that includes the cast-in plenum (shown in FIG. 3)
Figure 6:
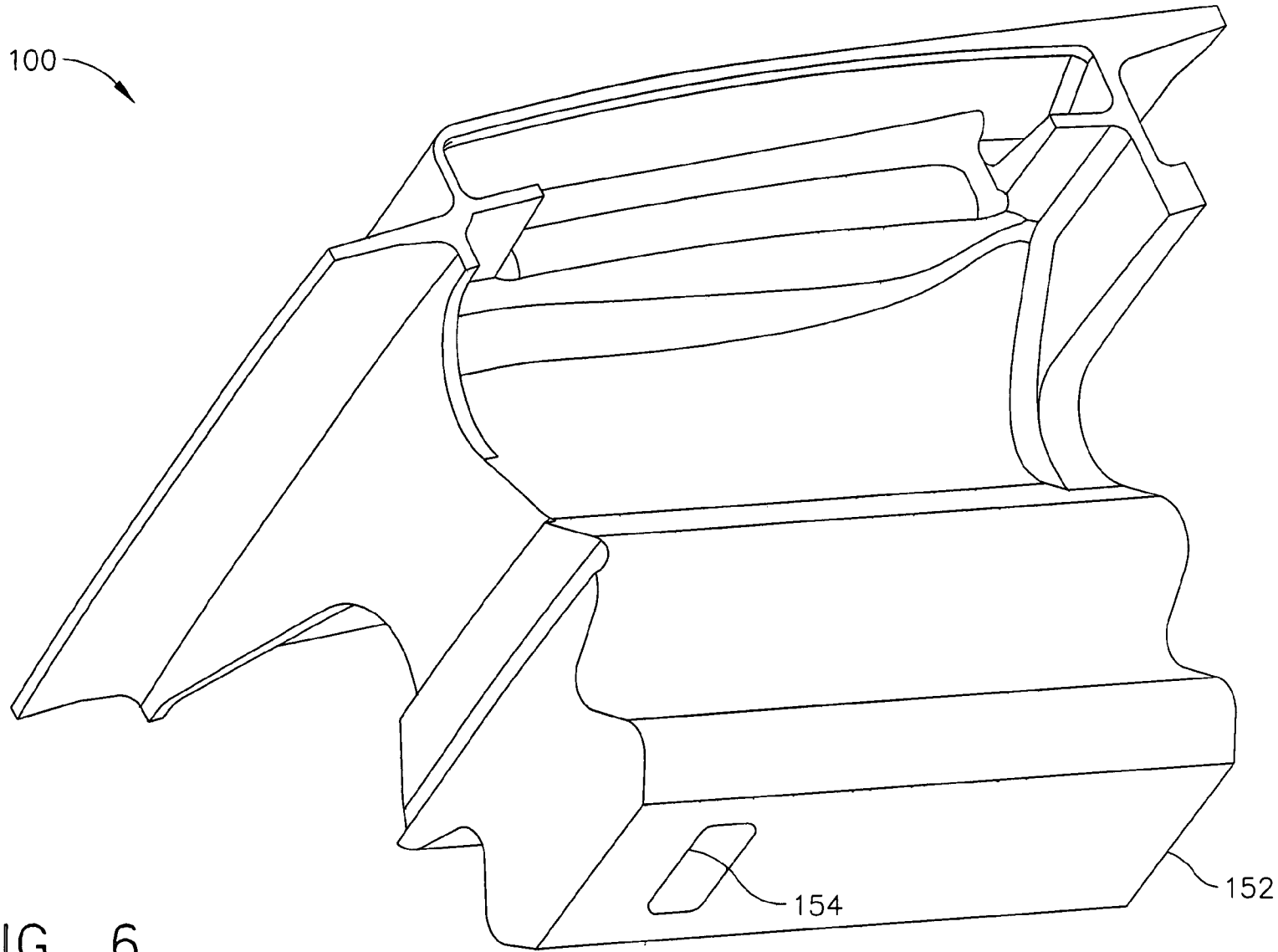
FIG. 6 is a bottom perspective view of the exemplary gas turbine rotor blade (shown in FIG. 2) that includes the cast-in plenum (shown in FIG. 3)

FIG. 3 is a perspective view of an exemplary cast-in plenum 100. FIG. 4 is a side perspective view of an exemplary gas turbine rotor blade 50 that includes cast-in plenum 100. FIG. 5 is a top perspective view of gas turbine rotor blade 50 including cast-in plenum 100. FIG. 6 is a bottom perspective view of gas turbine rotor blade 50 including cast-in plenum 100. In the exemplary embodiment, platform 62 includes an outer surface 102 and an inner surface 104 that defines cast-in plenum 100. More specifically, following casting and coring of turbine rotor blade 50, inner surface 104 defines a substantially U-shaped cast-in plenum 100 entirely within outer surface 102. Accordingly, in the exemplary embodiment, cast-in plenum 100 is formed unitarily with and completely enclosed within platform 62.

Cast-in plenum 100 includes a first plenum portion 106, a second plenum portion 108, and a third plenum portion 110 coupled in flow communication with plenums 106 and 108. First plenum portion 106 includes an upper surface 120, a lower surface 122, a first side 124, and a second side 126 that are each defined by inner surface 104. In the exemplary embodiment, first side 124 has a generally concave shape that substantially mirrors a contour of second sidewall 72. Second plenum portion 108 includes an upper surface 130, a lower surface 132, a first side 134, and a second side 136 each defined by inner surface 104. In the exemplary embodiment, first side 134 has a generally convex shape that substantially mirrors a contour of first sidewall 70. In the exemplary embodiment, platform 62 includes a substantially solid portion 140 that extends between first plenum portion 106, second plenum portion 108, and third plenum portion 110 such that portion 140 is bounded by first plenum portion 106, second plenum portion 108, and third plenum portion 110. More specifically, turbine rotor blade 50 is cored between first plenum portion 106, second plenum portion 108, and third plenum portion 110 such that a substantially solid base 140 is defined between airfoil 60, platform 62, and shank 64. Accordingly, fabricating rotor blade 50 such that cast-in plenum 100 is contained entirely within platform 62 facilitates increasing a structural integrity of turbine rotor blade 50.

Turbine rotor blade 50 also includes a channel 150 that extends from a lower surface 152 of dovetail 66 to cast-in plenum 100. More specifically, channel 150 includes an opening 154 that extends through shank 64 such that lower surface 152 is coupled in flow communication with cast-in plenum 100. Channel 150 includes a first end 156 and a second end 158. Second end 158 is coupled in flow communication to third plenum portion 110.

Turbine rotor blade 50 also include a plurality of openings 160 formed in flow communication with cast-in plenum 100 and extending between cast-in plenum 100 and platform outer surface 102. Openings 160 facilitate cooling platform 62. In the exemplary embodiment, openings 160 extend between cast-in plenum 100 and platform outer surface 102. In another embodiment, openings 160 extend between cast-in plenum 100 and a side 162 of platform outer surface 102. In yet another embodiment, openings 160 extend between cast-in plenum 100 and a lower portion 164 of platform outer surface 102. In the exemplary embodiment, openings 160 are sized to enable a predetermined amount of cooling airflow to be discharged therethrough to facilitate cooling platform 62.

During fabrication of cast-in plenum 100, a core (not shown) is cast into turbine blade 50. The core is fabricated by injecting a liquid ceramic and graphite slurry into a core die (not shown). The slurry is heated to form a solid ceramic plenum core. The core is suspended in an turbine blade die (not shown) and hot wax is injected into the turbine blade die to surround the ceramic core. The hot wax solidifies and forms a turbine blade with the ceramic core suspended in the blade platform.

The wax turbine blade with the ceramic core is then dipped in a ceramic slurry and allowed to dry. This procedure is repeated several times such that a shell is formed over the wax turbine blade. The wax is then melted out of the shell leaving a mold with a core suspended inside, and into which molten metal is poured. After the metal has solidified the shell is broken away and the core removed.

During engine operation, cooling air entering channel first end 156 is channeled through channel 150 and discharged into cast-in plenum 100. The cooling air is then channeled from cast-in plenum 100 through openings 160 and around platform outer surface 102 to facilitate reducing an operating temperature of platform 62. Moreover, the cooling air discharged from openings 160 facilitates reducing thermal strains induced to platform 62. Openings 160 are selectively positioned around an outer periphery 170 of platform 62 to facilitate compressor cooling air being channeled towards selected areas of platform 62 to facilitate optimizing the cooling of platform 62. Accordingly, when rotor blades 50 are coupled within the rotor assembly, channel 150 enables compressor discharge air to flow into cast-in plenum 100 and through openings 160 to facilitate reducing an operating temperature of platform 62.

Figure 7:
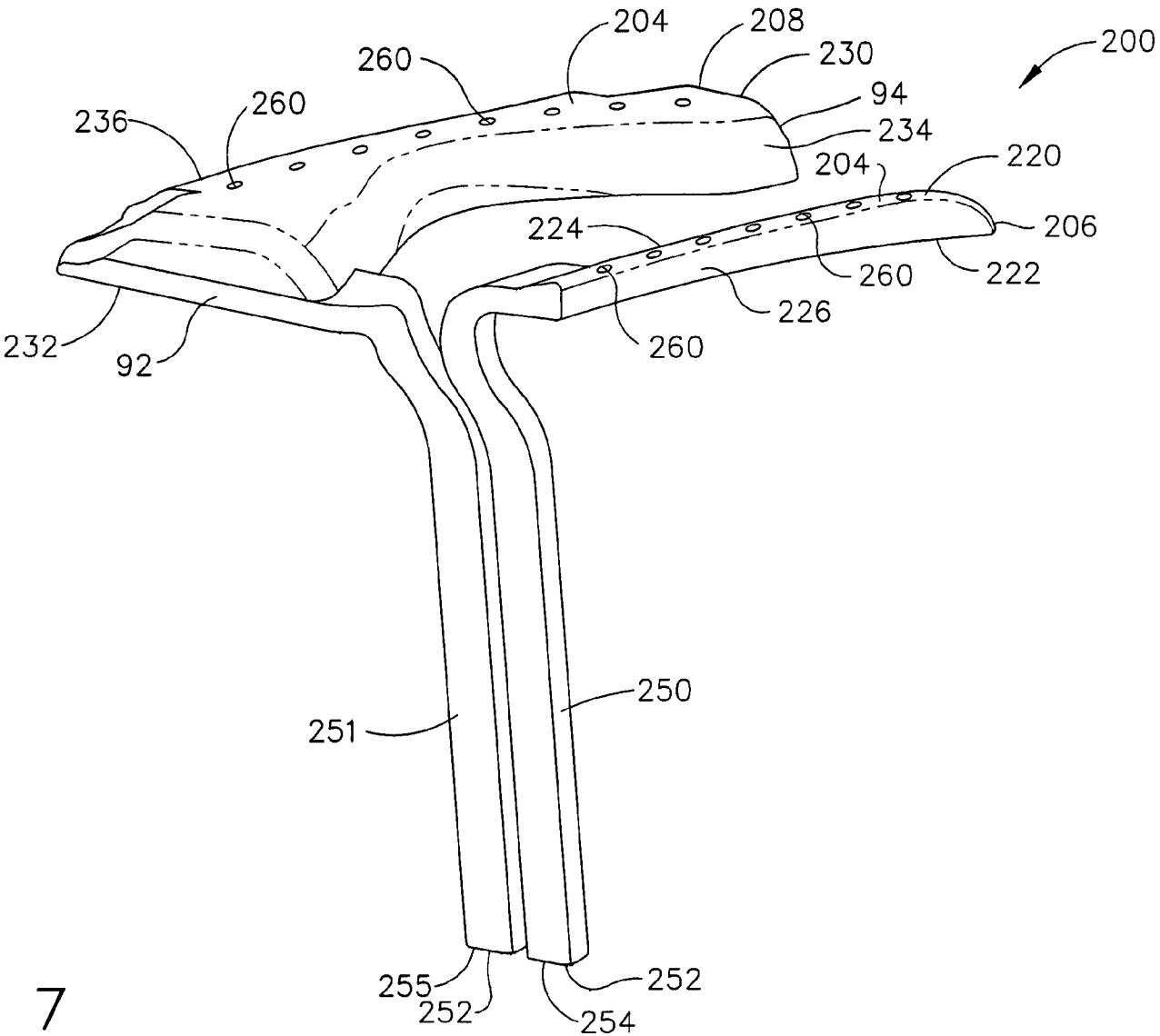
FIG. 7 is a perspective view of an exemplary cast-in plenum.

FIG. 7 is a perspective view of an exemplary cast-in plenum 200. In the exemplary embodiment, cast-in plenum 200 is formed unitarily with and completely enclosed within platform 62. Cast-in plenum 200 includes a first plenum portion 206, a second plenum portion 208. First plenum portion 206 includes an upper surface 220, a lower surface 222, a first side 224, and a second side 226 that are each defined by inner surface 204. In the exemplary embodiment, first side 224 has a generally concave shape that substantially mirrors a contour of second sidewall 72. Second plenum portion 208 includes an upper surface 230, a lower surface 232, a first side 234, and a second side 236 each defined by inner surface 204. In the exemplary embodiment, first side 234 has a generally convex shape that substantially mirrors a contour of first sidewall 70.

Turbine rotor blade 50 also includes a first channel 250 that extends from a lower surface 252 of dovetail 66 to first plenum portion 206 and a second channel 251 that extends from lower surface 252 of dovetail 66 to second plenum portion 208. In one embodiment, first and second channels 250, 251 are formed unitarily. In another embodiment, first and second channels 250, 251 are formed as separate components such that first channel 250 channels cooling air to first plenum portion 206 and second channel 251 channels cooling air to second plenum portion 208. In the exemplary embodiment, first and second channels 250, 251 are positioned along at least one of upstream side or skirt 90 and downstream side or skirt 92. More specifically, channel 250 includes an opening 254 that extends through shank 64 such that lower surface 252 is coupled in flow communication with first plenum portion 206 and channel 251 includes an opening 255 that extends through shank 64 such that lower surface 252 is coupled in flow communication with second plenum portion 208.

During engine operation, cooling air entering a first channel 250 and second channel 251 are channeled through channels 250 and 251 respectively and discharged into first plenum portion 206 and second plenum portion 208 respectively. The cooling air is then channeled from each respective plenum portion through openings 260 and around platform outer surface 102 to facilitate reducing an operating temperature of platform 62. Moreover, the cooling air discharged from openings 260 facilitates reducing thermal strains induced to platform 62. Openings 260 are selectively positioned around an outer periphery 170 of platform 62 to facilitate compressor cooling air being channeled towards selected areas of platform 62 to facilitate optimizing the cooling of platform 62. Accordingly, when rotor blades 50 are coupled within the rotor assembly, channels 250 and 251 enable compressor discharge air to flow into cast-in plenums 206 and 208 and through openings 260 to facilitate reducing an operating temperature of platform 62.

Figure 8:
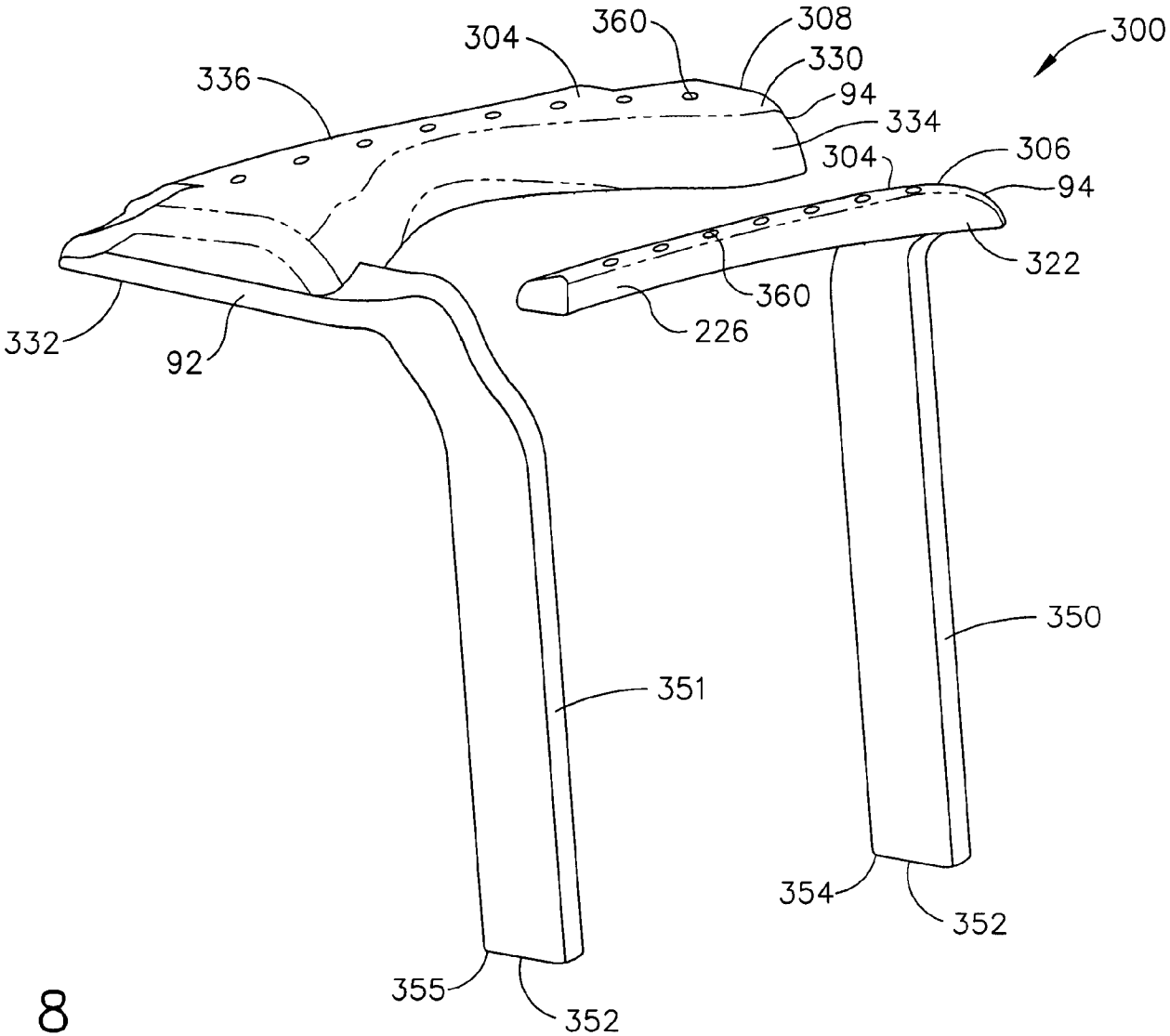
FIG. 8 is a perspective view of an exemplary cast-in plenum.

FIG. 8 is a perspective view of an exemplary cast-in plenum 300. In the exemplary embodiment, cast-in plenum 300 is formed unitarily with and completely enclosed within platform 62. Cast-in plenum 300 includes a first plenum portion 306 and a second plenum portion 308. First plenum portion 306 includes an upper surface 320, a lower surface 322, a first side 324, and a second side 326 that are each defined by inner surface 304. In the exemplary embodiment, first side 324 has a generally concave shape that substantially mirrors a contour of second sidewall 72. Second plenum portion 308 includes an upper surface 330, a lower surface 332, a first side 334, and a second side 336 each defined by inner surface 304. In the exemplary embodiment, first side 334 has a generally convex shape that substantially mirrors a contour of first sidewall 70.

Turbine rotor blade 50 also includes a first channel 350 that extends from a lower surface 352 of dovetail 66 to first plenum portion 306 and a second channel 351 that extends from lower surface 352 of dovetail 66 to second plenum portion 308. In the exemplary embodiment, first and second channels 350, 351 are formed as separate components such that first channel 350 channels cooling air to first plenum portion 306 and second channel 351 channels cooling air to second plenum portion 308. In the exemplary embodiment, first channel 350 is positioned along at least one of upstream side or skirt 90 and downstream side or skirt 92, and second channel 351 is positioned along at least one of upstream side or skirt 90 and downstream side or skirt 92 opposite first channel 350. More specifically, channel 350 includes an opening 354 that extends through shank 64 such that lower surface 352 is coupled in flow communication with first plenum portion 306, and second channel 351 includes an opening 355 that extends through shank 64 such that lower surface 352 is coupled in flow communication with second plenum portion 308.

During engine operation, cooling air entering a first channel 350 and second channel 351 are channeled through channels 350 and 351 respectively and discharged into first plenum portion 306 and second plenum portion 308 respectively. The cooling air is then channeled from each respective plenum portion through openings 360 and around platform outer surface 302 to facilitate reducing an operating temperature of platform 62. Moreover, the cooling air discharged from openings 360 facilitates reducing thermal strains induced to platform 62. Openings 360 are selectively positioned around an outer periphery 170 of platform 62 to facilitate compressor cooling air being channeled towards selected areas of platform 62 to facilitate optimizing the cooling of platform 62. Accordingly, when rotor blades 50 are coupled within the rotor assembly, channels 350 and 351 enable compressor discharge air to flow into cast-in plenums 306 and 308 and through openings 360 to facilitate reducing an operating temperature of platform 62.

The above-described rotor blades provide a cost-effective and reliable method for supplying cooling air to facilitate reducing an operating temperature of the rotor blade platform. More specifically, through cooling flow, thermal stresses induced within the platform, and the operating temperature of the platform is facilitated to be reduced. Accordingly, platform oxidation, platform cracking, and platform creep deflection is also facilitated to be reduced. As a result, the rotor blade cooling cast-in-plenums facilitate extending a useful life of the rotor blades and improving the operating efficiency of the gas turbine engine in a cost-effective and reliable manner. Moreover, the method and apparatus described herein facilitate stabilizing platform hole cooling flow levels because the air is provided directly to the cast-in plenum via a dedicated channel, rather than relying on secondary airflows and/or leakages to facilitate cooling platform 62. Accordingly, the method and apparatus described herein facilitates eliminating the need for fabricating shank holes in the rotor blade.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade cooling circuit component can also be used in combination with other rotor blades, and is not limited to practice with only rotor blade 50 as described herein. Rather, the present invention can be implemented and utilized in connection with many other blade and cooling circuit configurations. For example, the methods and apparatus can be equally applied to rotor vanes such as, but not limited to an HPT vanes.

While the invention has been described in terms of various specific embodiments, those skilled in the art will recognize that the invention can be practiced with modification within the spirit and scope of the claims.

What is claimed is:

1. A method for fabricating a turbine rotor blade, said method comprising:

casting a turbine rotor blade including a dovetail, a platform having an outer surface, an inner surface, and a cast-in plenum defined between the outer surface and the inner surface, an airfoil, and at least one channel having an exit positioned in flow communication with the cast-in plenum and an entrance positioned in a dovetail lower surface, wherein the at least one channel extends from the entrance to the cast-in plenum to enable cooling air to flow directly from the entrance into the cast-in plenum; and forming a plurality of openings extending between the cast-in plenum and at least one of the platform inner surface and the platform outer surface, such that the at least one channel facilitates channeling cooling air through the plurality of openings to an exterior surface of the platform.

2. A method in accordance with claim 1 wherein casting a turbine rotor blade further comprises casting the turbine rotor blade to include a first plenum portion, a second plenum portion, and a third plenum portion that is coupled in flow communication with the first and the second plenum portions.

3. A method in accordance with claim 1 wherein casting a turbine rotor blade further comprises casting turbine rotor blade to include a first plenum portion, a second plenum portion, a first channel extending between the dovetail lower surface and the cast-in plenum first portion, and a second channel extending between the dovetail lower surface and the cast-in plenum second portion.

4. A method in accordance with claim 3 wherein casting a turbine rotor blade further comprises casting the turbine rotor blade to include a first channel extending between the dovetail lower surface and the cast-in plenum first portion, and a second channel extending between the dovetail lower surface and the cast-in plenum second portion, the first and second channels extending along at least one of a platform upstream side and a platform downstream side.

5. A method in accordance with claim 3 wherein casting a turbine rotor blade further comprises casting the turbine rotor blade to include a first channel extending between the dovetail lower surface and the cast-in plenum first portion, and a second channel extending between the dovetail lower surface and the cast-in plenum second portion, the first channel extending along at least one of a platform upstream side and a platform downstream side, the second channel extending along at least one of a platform upstream side and a platform downstream side opposite the first channel.

6. A method in accordance with claim 1 wherein casting a turbine rotor blade further comprises casting the turbine rotor blade to include a first plenum portion including a first side that is substantially concave, and a second plenum portion having a first side that substantially convex, the first and second plenum portions each including a plurality of openings selectively sized to facilitate channeling a predetermined quantity of cooling air to an exterior surface of the platform.

7. A method in accordance with claim 1 wherein casting a turbine rotor blade further comprises casting the turbine rotor blade to include a platform including a substantially solid portion and a substantially U-shaped cast-in plenum extending around the solid portion and between the platform outer surface and the platform inner surface, wherein the solid portion facilitates increasing a structural integrity of the turbine rotor blade.

8. A turbine rotor blade comprising:

a dovetail;

a platform coupled to said dovetail, said platform comprising a cast-in plenum formed within said platform;

an airfoil coupled to said platform;

at least one channel comprising an exit positioned in flow communication with said cast-in plenum and an entrance positioned in with a dovetail lower surface, said at least one channel extending from said entrance to the cast-in plenum to enable cooling air to flow directly from said entrance into said cast-in plenum; and a cooling source coupled in flow communication to said cast-in plenum.

9. A turbine rotor blade in accordance with claim 8 wherein said cast-in plenum comprises a first plenum portion, a second plenum portion, and a third plenum portion coupled in flow communication with said first and said second plenum portions.

10. A turbine rotor blade in accordance with claim 8 further comprising a first plenum portion, a second plenum portion, a first channel that extends between said dovetail lower surface and said cast-in plenum first portion, and a second channel that extends between said dovetail lower surface and said cast-in plenum second portion.

11. A turbine rotor blade in accordance with claim S wherein said turbine rotor blade further comprises a first channel extending between said dovetail lower surface and a cast-in plenum first portion, and a second channel extending between said dovetail lower surface and a cast-in plenum second portion, said first and second channels extending along at least one of a platform upstream side and a platform downstream side.

12. A turbine rotor blade in accordance with claim 8 wherein said turbine rotor blade further comprises a first channel extending between said dovetail lower surface and a cast-in plenum first portion, and a second channel extending between said dovetail lower surface and a cast-in plenum second portion, said first channel extends along at least one of a platform upstream side and a platform downstream side, said second channel extends along at least one of said platform upstream side and said platform downstream side opposite said first channel.

13. A turbine rotor blade in accordance with claim 8 wherein said cast-in plenum further comprises a first plenum portion comprising a first side that includes a generally concave profile, a second plenum portion comprising a first side that includes a generally convex profile, and a plurality of openings extending between said cast-in plenum and a platform outer surface, said plurality of openings sized to facilitate channeling a predetermined quantity of cooling air to said platform outer surface.

14. A turbine rotor blade in accordance with claim 8 wherein said platform comprises a substantially solid portion and a substantially U-shaped cast-in plenum extending around said solid portion, wherein said solid portion facilitates increasing a structural integrity of said turbine rotor blade.

15. A gas turbine engine rotor assembly comprising:

a rotor; and a plurality of circumferentially-spaced rotor blades coupled to said rotor, each said rotor blade comprising a dovetail, a platform coupled to said dovetail, said platform comprising a cast-in plenum formed within said platform, an airfoil coupled to said platform, at least one channel comprising an exit positioned in flow communication with said cast-in plenum and an entrance positioned in a dovetail lower surface, said at least one channel extending from said entrance to said cast-in plenum, and a cooling source coupled in flow communication to said cast-in plenum such that cooling air flows directly from said entrance into said cast-in plenum.

16. A gas turbine engine rotor assembly in accordance with claim 15 wherein said cast-in plenum comprises a first plenum portion, a second plenum portion, and a third plenum portion coupled in flow communication with said first and said second plenum portions.

17. A gas turbine engine rotor assembly in accordance with claim 15 further comprising a first plenum portion, a second plenum portion, a first channel that extends between said dovetail lower surface and said cast-in plenum first portion, and a second channel that extends between said dovetail lower surface and said cast-in plenum second portion.

18. A gas turbine engine rotor assembly in accordance with claim 15 wherein said turbine rotor blade further comprises a first channel extending between said dovetail lower surface and a cast-in plenum first portion, and a second channel extending between said dovetail lower surface and a cast-in plenum second portion, said first and second channels extending along at least one of a platform upstream side and a platform downstream side.

19. A gas turbine engine rotor assembly in accordance with claim 15 wherein said turbine rotor blade further comprises a first channel extending between said dovetail lower surface and a cast-in plenum first portion, and a second channel extending between said dovetail lower surface and a cast-in plenum second portion, said first channel extends along at least one of a platform upstream side and a platform downstream side, said second channel extends along at least one of said platform upstream side and said platform downstream side opposite said first channel.

20. A gas turbine engine rotor assembly in accordance with claim 15 wherein said cast-in plenum further comprises a first plenum portion comprising a first side that includes a generally concave profile, a second plenum portion comprising a first side tat includes a generally convex profile, and a plurality of openings extending between said cast-in plenum and a platform outer surface, said plurality of openings sized to facilitate channeling a predetermined quantity of cooling air to said platform outer surface.

* * * * *

UNITED STATES PATENT AND TRADEMARK OFFICE

CERTIFICATE OF CORRECTION

PATENT NO. : 7,144,215 B2
APPLICATION NO. : 10/903414
DATED : December 5, 2006
INVENTOR(S) : Keith et al.

It is certified that error appears in the above-identified patent and that said Letters Patent is hereby corrected as shown below:

In Claim 8, column 8, line 11, delete "in with a dovetail" and insert therefor -- in a dovetail --.

In Claim 20, column 10, line 19, delete "side tat includes" and insert therefor -- side that includes --.

Signed and Sealed this

Fourth Day of December, 2007

JON W. DUDAS
*Director of the United States Patent and Trademark Office*